US005399479A

United States Patent [19]

Lok

[11] Patent Number: 5,399,479

[45] Date of Patent: Mar. 21, 1995

[54] PHOTOGRAPHIC ELEMENT EXHIBITING IMPROVED SPEED AND STABILITY

[75] Inventor: Roger Lok, Rochester, N.Y.

[73] Assignee: Eastman Kodak Company, Rochester, N.Y.

[21] Appl. No.: 168,892

[22] Filed: Dec. 16, 1993

[51] Int. Cl.[6] ..... G03C 1/09

[52] U.S. Cl. ..... 430/603; 430/567; 430/569; 430/599; 430/605; 430/607; 430/611; 430/600

[58] Field of Search ..... 430/599, 603, 604, 605, 430/607, 611, 567, 569, 600

[56] References Cited

U.S. PATENT DOCUMENTS

| | | | |
|---|---|---|---|
| H1090 | 8/1992 | Fukawa et al. | 430/264 |
| T103,803 | 1/1984 | Lok et al. | 548/121 |
| 2,394,198 | 2/1946 | Mueller . | |
| 3,782,959 | 1/1974 | Bigelow . | |
| 4,378,426 | 3/1983 | Lok et al. | 430/600 |
| 4,451,557 | 5/1984 | Lok et al. | 430/600 |
| 4,471,044 | 9/1984 | Parton et al. | 430/217 |
| 4,639,415 | 1/1987 | Kaneko et al. | 430/558 |
| 4,814,262 | 3/1989 | Sugita et al. | 430/551 |
| 4,820,614 | 4/1989 | Takada et al. | 430/505 |
| 4,835,093 | 5/1989 | Janusionis et al. | 430/567 |
| 4,933,272 | 6/1990 | McDugle et al. | 430/605 |
| 5,079,138 | 1/1992 | Takada | 430/567 |
| 5,110,719 | 5/1992 | Shuto et al. | 430/569 |

FOREIGN PATENT DOCUMENTS

| | | |
|---|---|---|
| 0348934 | 6/1989 | European Pat. Off. . |
| 0368304 | 11/1989 | European Pat. Off. . |
| 0358170 | 3/1990 | European Pat. Off. . |
| 0369424 | 5/1990 | European Pat. Off. . |
| 0369491 | 5/1990 | European Pat. Off. . |
| 0371338 | 6/1990 | European Pat. Off. . |
| 0435355 | 12/1990 | European Pat. Off. . |
| 0325235 | 7/1991 | European Pat. Off. . |
| 0457298 | 11/1991 | European Pat. Off. . |
| 3908835 | 9/1989 | Germany . |
| 63/149642 | 12/1986 | Japan . |
| 62-198859 | 9/1987 | Japan . |
| 4/083241 | 7/1990 | Japan . |
| 3/208041 | 9/1991 | Japan . |
| 92/16876 | 10/1992 | WIPO . |

OTHER PUBLICATIONS

Wiss. Photolab. Publication, Translation 63(1965), pp. 63–72.

*Primary Examiner*—Charles L. Bowers, Jr.
*Assistant Examiner*—Mark F. Huff
*Attorney, Agent, or Firm*—Peter C. Cody

[57] ABSTRACT

The present invention provides a photographic element comprising a support having thereon a silver halide emulsion layer. The emulsion layer contains an organic compound having a thiosulfonic acid substituent, an organic compound having a sulfinic acid substituent, and an alkynylamine.

22 Claims, No Drawings

PHOTOGRAPHIC ELEMENT EXHIBITING IMPROVED SPEED AND STABILITY

FIELD OF THE INFORMATION

This invention relates to photographic elements. In particular, it relates to novel photographic silver halide elements exhibiting high sensitivity and excellent resistance to storage changes.

BACKGROUND OF THE INVENTION

For more than a century, it has been known that certain materials are sensitive to actinic radiation and, upon exposure to such radiation, form latent images capable of being subsequently developed into a useful visible image. Almost exclusively, commercial application of these radiation sensitive materials has been the domain of silver halides which exhibit superior sensitivity to light over other radiation sensitive materials, some of which have been known for as long as silver halides have been in use. Such superior sensitivity has made silver halides more practical for use in cameras and other photographic equipment since they can be utilized in low light situations, or in situations where the mechanical characteristics of a camera (or other exposure means) would interfere with an optimum exposure.

Because it is desirable to improve the sensitivity of silver halide crystals, and hence the photographic elements in which they are contained, photographic chemists have over the years attempted to vary the processes for making, or the components within, silver halide emulsions. Typically, the process of making photographic emulsions has consisted of the following steps:

1. The formation of a dispersion of microcrystals (grains) of silver halide in a solution of protective colloid.
2. Physical ripening to achieve the desired grain size.
3. The freeing of the dispersion from excess soluble salts by washing or by coagulation followed by redispersal in a salt free medium.
4. A heat treatment, often in the presence of sensitizing agents, to increase light sensitivity. The treatment is variously termed after-ripening, second ripening, chemical ripening, or digestion.
5. Addition of agents that confer the desired properties, such as sensitizing dyes, antifoggants and stabilizers, and hardeners.

It is during these steps that photographic chemists have added additional components to the emulsion, or varied the conditions under which the emulsion is formed, in order to optimize certain emulsion characteristics. One such characteristic is contrast, and it is generally desired that contrast be maximized.

High contrast is desirable because it is directly related to the appearance of sharpness in an emulsion. One measure of contrast is the sharpness of the toe section of an emulsion's D-log E curve. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point, which is defined as the point on the D-log E curve where density equals 1.0.

It has been known that improvements in the contrast of photographic emulsions can be obtained by employing various transition metals as either dopants or grain surface modifiers. Dopants are substances added to an emulsion during silver halide precipitation which typically become incorporated within the internal structure of the silver halide grains. Grain surface modifiers, by contrast, are added post-precipitation, thus becoming associated with the surface of the silver halide grains rather than their internal structure.

Recently, emulsion dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third, dicesium pentachloronitrosyl osmate, is disclosed in U.S. Pat. No. 4,933,272. The third is known, in certain instances, to increase the contrast of photographic emulsions. It does so, however, at the expense of a corresponding decrease in sensitivity. Sensitivity (or "speed") of an emulsion is usually defined as the reciprocal of the relative amount of light in Log E$\times$100 to produce 1.0 density.

It has been recognized in the art that photographic sensitivity (speed) can be increased by adjusting the pH and/or the pAg of a silver halide emulsion. It has also been known that enhanced photographic sensitivity can be obtained by the addition of certain types of chemical sensitizers. Several types of sensitizers have been identified. The most prevalent are gold and sulfur compounds, both of which are thought to enhance emulsion speed by forming electron or photohole traps on the silver halide crystal surface.

Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers. The overall effect of these metals on sensitivity appears to be dependant upon their valence state.

The ability of certain alkynylamines to produce increases in speed when incorporated into photographic emulsions as grain surface modifiers (post-precipitation) has been described in prior U.S. Pat. Nos. 4,378,426 and 4,451,557.

Reduction sensitization is another means by which sensitivity enhancement can be obtained. Known reducing agents include stannous chloride, ascorbic acid (as in European Patent Applications 0369491 and 0369424) and dimethylamine borane (U.S. Pat. Nos. 4,150,093 and 3,782,959). However, the use of such sensitizers, as well as other types of sensitizers described above, often causes an indiscriminant, and undesirable, reduction of silver ions to silver atoms. The silver atoms give rise during development to a generally or locally developed density that is not associated with the action of the image forming exposure. This density is typically termed fog and it is best measured as the minimum density on the emulsion's D-Log E curve ($D_{min}$).

Fog is undesirable because it is an indication that the discrimination between the photographic image and the unexposed area is reduced. Thus, the quality of the image obtained is less than optimal. For silver chloride emulsions, which are more prone to being reduced than emulsions containing silver bromide or silver iodide (or mixtures thereof), this problem is even more severe.

A problem closely linked with fog is the tendency for silver halide emulsions, whether chemically sensitized or not, to exhibit unwanted sensitometric changes—such as an increase in speed—during their storage (aging). The ability of an emulsion to be resistant to these storage changes is called the emulsion's stability (or "keeping ability").

To improve an emulsion's stability, and to control the formation of fog, it has been known to add to the emulsion chemicals known as antifoggants and stabilizers. Because some of these compounds function in both capacities often only one compound is added.

Known antifoggants include the mercaptotetrazoles, tetraazaindenes, benzothiazolium salts, and the thiosulfonates. The thiosulfonates, in particular, have been the subject of much study in recent years. Examples of their uses can be found in the following references: European Patent Applications 0369424, 0435355, 0371338, 0368304, 0348934, U.S. Pat. No. 5,079,138, German Patent 3,908,835, JO3,237,453 and JP4,083,241, as well as in S. Gahler in Veroff. wiss. Photolab. Wolfen X, 63(1965), and in Z. Wiss. Photo. 63 133(1969).

Thiosulfonates, and especially their alkali salts, suffer the disadvantage of being particularly prone to decomposition. Such decomposition, if not carefully controlled, often gives rise to unacceptable photographic emulsions exhibiting variable speed and high fog.

One method of improving the antifoggant/stabilizer effects of thiosulfonates is to incorporate them into an emulsion along with an amount of sulfinate salt. U.S. Pat. No. 2,394,198 discloses an improvement in the effects of sulfinate salts by the addition to silver halide emulsions amounts of thiosulfonates. Japanese Kokai 3-208041 discloses the use of thiosulfonates and sulfinates during grain formation to make the antifogging effect more obvious. European Patent Application 0358170 discloses the use of thiosulfonates and sulfinates in a direct positive emulsion.

Although the combination of thiosulfonates and sulfinates is known, emulsions containing this combination lack the desired degree of sensitivity and resistance to storage changes. It is therefore desired to provide photographic emulsions containing thiosulfonates and sulfinates which exhibit high sensitivity and resistance to storage changes. Furthermore, it is desired that such emulsions exhibit their characteristics without exhibiting any significant loss in contrast.

SUMMARY OF THE INVENTION

The present invention provides a photographic element comprising a support having thereon a silver halide emulsion layer, wherein the emulsion layer contains an organic compound having a thiosulfonic acid substituent, an organic compound having a sulfinic acid substituent, and an alkynylamine.

The combination of these compounds in a silver halide emulsion, and especially an emulsion which is predominantly silver chloride, imparts to the emulsion the advantageous characteristics of high sensitivity and excellent resistance to storage changes. When the above compounds are further combined with transition metal complex comprising a nitrosyl or thionitrosyl ligand and a transition metal selected from groups V to X, inclusive, of the periodic table adopted by the American Chemical Society and published in the *Chemical and Engineering News*, Feb. 4, 1985, p.26, the advantages of the invention can be realized without any significant loss of contrast in the emulsion.

DETAILED DESCRIPTION OF THE INVENTION

The present invention concerns silver halide elements which contain several adjuvants and which exhibit the desired characteristics of high sensitivity and stability. Specifically, the elements contemplated by the present invention contain a combination of antifoggant/stabilizer compounds. The first of these is an organic compound having a thiosulfonic acid substituent; the second is an organic compound having a sulfinic acid substituent. They are structurally defined below by formulas I and II, respectively:

$$R^1—SO_2S—M^1 \quad \text{(Formula I)}$$

$$R^2—SO_2—M^2 \quad \text{(Formula II)}$$

For each compound the R substituent, whether $R^1$ or $R^2$, independently represents an aliphatic, carbocyclic (which includes an aryl), or heterocyclic group, which may be substituted or unsubstituted. Preferably, the R substituents are independently selected from the group consisting of an unsubstituted or substituted alkyl of 1 to 22 carbon atoms, an unsubstituted or substituted aryl group having 6 to 20 carbon atoms, or an unsubstituted or substituted 3-membered to 15-membered heterocyclic group having one or two heteroatoms.

Examples of suitable aliphatic groups include methyl, ethyl, propyl, butyl, pentyl, hexyl, octyl, ethylhexyl, decyl, dodecyl, hexadecyl, octadecyl, isopropyl, t-butyl, butenyl, propynl, and butynyl.

Examples of suitable carbocyclic groups are phenyl, tolyl, naphthyl, cyclohexyl, cycloheptatrienyl, cyclooctatrienyl, and cyclononatrienyl.

Examples of suitable heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

Groups suitable for substitution on $R^1$ or $R^2$ include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

The R substituents may further be associated with one or more divalent linking groups. The linking groups include an atom or group containing at least one atom of carbon, nitrogen, sulfur, or oxygen. Examples include alkylene, alkenylene, alkynylene, arylene, O, S, NH, CO, and $SO_2$. When such a linking group is present in the antifoggant/stabilizer compound, the compound is preferably a polymer.

For each of the compounds represented by formulas I and II, $M^1$ and $M^2$ independently represent any mono-, di-, or tri-valent cation. Thus, $M^1$ and $M^2$ include metal ions such as sodium ions, potassium ions, calcium ions, and lithium ions, as well as, ammonium ions and phosphonium ions. Preferably, $M^1$ and $M^2$ represent sodium ions.

In a preferred embodiment of the present invention, the emulsions contain an organic compound having a thiosulfonic acid substituent (formula I) in an amount between about 20 and about 2300 milligrams per mole of silver halide, and an organic compound having a sulfinic acid substituent (formula II) in an amount between about 20 and about 20,000 milligrams per mole of silver halide, with the ratio of the compound containing the thiosulfonic acid substituent to the compound containing the sulfinic acid substituent being between about 20:1 and about 1:20 by weight. Preferably, the emulsions contain an organic compound having a thiosulfonic acid substituent in an amount between about 100 and about 1500 milligrams per mole of silver halide, and an organic compound having a sulfinic acid substituent in an amount between about 100 and 15,000 milligrams per mole of silver halide, with the ratio of thiosulfonic acid substituent to sulfinic acid substituent being between about 10:1 and about 1:10 by weight.

Optimally, the above-described compounds are tolylthiosulfonate salts and tolylsulfinate salts, respectively. They, and other preferred examples of antifoggants/-stabilizers, can be synthesized by methods known in the art and described, for example, in *Journal of Organic Chemistry*, vol. 53, p. 386 (1988) and *Chemical Abstracts*, vol. 59, 9777e.

In accordance with the present invention, the contemplated elements also contain an alkynylamine, which may be generically defined by the following structural formula:

$$Y—NHCH_2C{\equiv}CR^3$$

wherein $R^3$ represents a hydrogen atom, aliphatic, carbocyclic (including aryl), or heterocyclic group, which may be substituted or unsubstituted. Preferably, $R^3$ is other than hydrogen. More preferably, it is an alkyl having 1 to 20 carbon atoms. And optimally, it is a methyl group.

Examples of suitable aliphatic groups include methyl, ethyl, propyl, butyl, pentyl, hexyl, octyl, ethylhexyl, decyl, dodecyl, hexadecyl, octadecyl, isopropyl, t-butyl, butenyl, propynyl, and butynyl. Examples of suitable carbocyclic groups are phenyl, tolyl, naphthyl, cyclohexyl, cycloheptatrienyl, cyclooctatrienyl, cyclononatrienyl, p-methoxyphenyl, and p-chlorophenyl.

Examples of suitable heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

The substituent represented by Y above is preferably a nitrogen containing heterocycle (including a heterocyclic ring system of two or more fused rings). Thus, Y includes substituted and unsubstituted oxazoles, thiazoles, selenazoles, oxadiazoles, thiadiazoles, triazoles, tetrazoles, pyrimidines, pyrroles, pyridines, quinolines, and benzimidazoles. Preferably, Y is a nitrogen containing azole.

Groups suitable for substitution on Y (as well as $R^3$) include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups, acylamino groups, sulfonylamino groups, cyano groups and acyloxy groups (for example, acetoxy, benzoxy).

Preferred alkynylamines are ones in which the alkynylamine is substituted on the carbon of a N=C moiety as shown in the following structure:

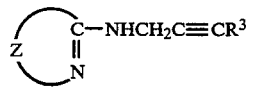

wherein Z represents atoms necessary to complete a five to nine-membered heterocyclic ring system, preferably a nine-membered fused heteroaromatic ring system such as a benzoxazole. $R^3$ in this structure is defined as above.

The most preferred alkynylamines contain benzoxazole, benzoselenazole, or benzothiazole moieties, and are represented by the following structure:

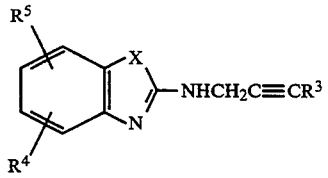

wherein X represents a substituted or unsubstituted nitrogen; or oxygen, sulfur, or selenium, preferably oxygen; $R^3$ is as defined above; and $R^5$ and $R^4$ independently represent hydrogen, a halogen, or a substituted or unsubstituted alkyl or alkoxy group, preferably one having from 1 to 10 carbon atoms.

In the alkynylamines described above, $R^4$ and $R^5$ are preferably in the 5 and 6 positions, respectively.

It is also contemplated that the alkynylamines of the present invention be water soluble; that is, they further comprise a water solubilizing group. In this embodiment, the water solubilizing group can be substituted anywhere on the alkynylamine (e.g. as or on $R^3$, $R^4$, or $R^5$), preferably not on the nitrogen atom of the amine group. Preferably, it should be sufficient to enable the alkynylamine to be soluble at 0.1 grams per liter of water. Representative solubilizing groups include carboxy, carboxyalkyl, sulfo, sulfoalkyl, phosphato, phosphatoalkyl, phosphono, phosphonoalkyl, carbonamido, sulfonamido, hydroxy, and salts thereof. Preferably, the water solubilizing group is a carboxy or sulfo group, or salt thereof. Optimally, it is the sodium or potassium salt of a carboxy group.

Specific compounds contemplated to be within the scope of the present invention include:

Compound A:

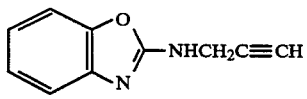

Compound B:

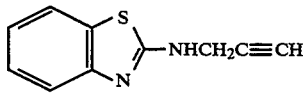

-continued

Compound C:

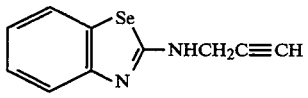

Compound D:

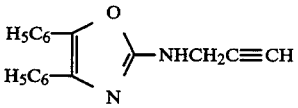

Compound E:

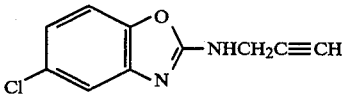

Compound F:

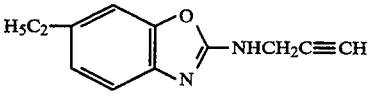

Compound G:

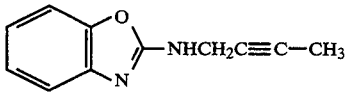

Compound H:

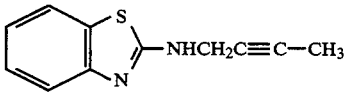

Compound I:

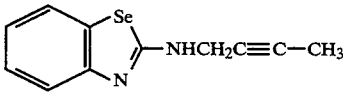

Compound J:

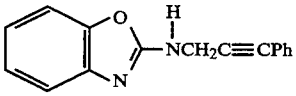

Compound K:

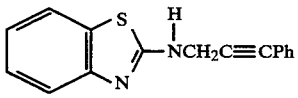

Compound L:

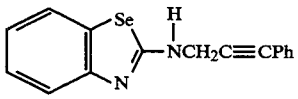

Compound M:

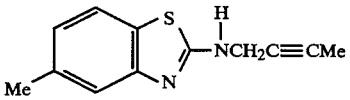

Compound N:

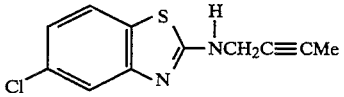

Compound O:

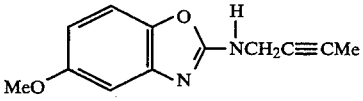

Compound P:

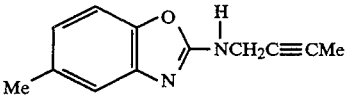

Compound Q:

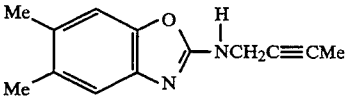

The alkynylamines are preferably incorporated into the emulsion in an amount between about 0.1 and about 1000 milligrams per mole of silver halide. A more preferred level of incorporated alkynylamine is between about 1 and about 500 milligrams per mole of silver halide.

Ideally, the alkynylamine of the present invention is butynylaminobenzoxazole (compound G). It is preferably incorporated into the emulsion in an amount between about 1 milligram per mole of silver halide and about 200 milligrams per mole of silver halide. More preferably, it is incorporated in an amount between about 5 and about 50 milligrams per mole of silver halide; and optimally, it is incorporated in an amount between about 5 and about 20 milligrams per mole of silver halide.

The alkynylamine of the invention may be prepared by any methods known in the art. Examples of such methods can be found in U.S. Pat. Nos. 4,451,557 and 4,378,426, and in co-pending and concurrently filed U.S. patent application Ser. No. 08/169,833, all of which are incorporated herein by reference.

The alkynylamine, as well as the compounds of formulas I and II, may be added to a black and white or color emulsion layer at any time during the preparation of the photographic element, including during the precipitation of the silver halide grains. It is preferred, though, that they be added post-precipitation and just prior to coating the emulsion on a support.

It is also preferred that the above compounds be added to emulsions comprised of predominantly silver chloride. Although it is specifically contemplated that the advantages of the invention would be present in emulsions containing silver halide grains of any type (silver bromide, chloride, or iodide, or mixtures thereof) or form (i.e. cubic, octahedral, dodecahedral, spherical or tabular), silver chloride content of at least 70 molar percent and silver iodide content of less than 2 molar percent is preferred. Even more preferred is an emulsion containing 98 molar percent silver chloride, with the remaining silver halide being silver bromide and silver iodide. Most preferred is an emulsion containing silver chloride as the sole silver halide.

Irrespective of the type of grains employed in the present invention, it is preferred in certain embodiments of the invention that such grains be internally or externally modified by a dopant or grain surface modifier. Utilization of modified grains enables the emulsion to exhibit the desired characteristics of high sensitivity and excellent stability without also exhibiting the loss of contrast which is often observed in emulsions containing reduction sensitizers.

The dopant or grain surface modifier suitable for the invention is preferably a transition metal complex. It may be generically defined by the formula:

$$[ML_m(NZ)]^n$$

wherein

M is a transition metal selected from the Groups V to X, inclusive, of the periodic table adopted by the American Chemical Society and published in the *Chemical and Engineering News*, Feb. 4, 1985, p.26;

Z is oxygen or sulfur, and together with nitrogen forms the nitrosyl or thionitrosyl ligand;

L represents a ligand additional to the nitrosyl or thionitrosyl ligand;

m is from 4 to 7, preferably 5 or 6; and n is zero, −1, −2, or −3.

The ligands defined above by L can represent virtually any known type of ligand. Any combination of ligands is contemplated. Specific examples of preferred ligands include aquo ligands, halide ligands, cyanide ligands, cyanate ligands, thiocyanate ligands, selenocyanate ligands, tellurocyanate ligands, azide ligands, and other nitrosyl or thionitrosyl ligands.

Preferred dopants and grain surface modifiers include:

TMC-1 $[V(NO)(CN)_5]^{-3}$
TMC-2 $[Cr(NO)(CN)_5]^{-3}$
TMC-3 $[Mn(NO)(CN)_5]^{-3}$
TMC-4 $[Fe(NO)(CN)_5]^{-2}$
TMC-5 $[Ru(NO)Cl_5]^{-2}$
TMC-6 $[Ru(NO)Br_5]^{-2}$
TMC-7 $[Ru(NO)I_5]^{-2}$
TMC-8 $[Ru(NO)F_5]^{-2}$
TMC-9 $[Ru(NO)Cl_3(H_2O)_2]^0$
TMC-10 $[Ru(NO)Cl_3(H_2O)]^{-1}$
TMC-11 $[Ru(NO)Cl_4(OCN)]^{-2}$
TMC-12 $[Ru(NO)Cl_4(CN)]^{-2}$
TMC-13 $[Ru(NO)I_4(TeCN)]^{-2}$
TMC-14 $[Ru(NO)Cl_4(SCN)]^{-2}$
TMC-15 $[Ru(NO)Br_4(SeCN)]^{-2}$
TMC-16 $[Ru(NO)I_4(SeCN)]^{-2}$
TMC-17 $[Ru(NO)Cl_3(CN)_2]^{-2}$
TMC-18 $[Ru(NO)Br_2(CN)_3]^{-2}$
TMC-19 $[Ru(NO)I_2(CN)_3]^{-2}$
TMC-20 $[Ru(NO)Cl_4(N)_3]^{-2}$
TMC-21 $[Ru(NO)Cl(CN)_4]^{-2}$
TMC-22 $[Ru(NO)Br(SCN)_4]^{-2}$
TMC-23 $[Ru(NO)I(SCN)_4]^{-2}$
TMC-24 $[Ru(NO)I(CN)_5]^{-2}$
TMC-25 $[Os(NO)Cl_5]^{-2}$
TMC-26 $[Os(NO)Br_5]^{-2}$
TMC-27 $[Os(NO)I_5]^{-2}$
TMC-28 $[Os(NO)F_5]^{-2}$
TMC-29 $[Os(NO)Cl_4(TeCN)]^{-2}$
TMC-30 $[Os(NO)Br_4(OCN)]^{-2}$
TMC-31 $[Os(NO)I_4(TeCN)]^{-2}$
TMC-32 $[Os(NO)Cl_4(SeCN)]^{-2}$
TMC-33 $[Os(NO)Br_4(SeCN)]^{-2}$
TMC-34 $[Os(NO)I_4(SeCN)]^{-2}$
TMC-35 $[Os(NO)Cl_3(CN)_2]^{-2}$
TMC-36 $[Os(NO)Br_2(CN)_3]^{-2}$
TMC-37 $[Os(NO)I_2(SCN)_3]^{-2}$
TMC-38 $[Os(NO)Cl_2(SCN)_3]^{-2}$
TMC-39 $[Os(NO)Cl(CN)_4]^{-2}$
TMC-40 $[Os(NO)Br(CN)_4]^{-2}$
TMC-41 $[Os(NO)I(SCN)_4]^{-2}$
TMC-42 $[Os(NO)(CN)_5]^{-2}$
TMC-43 $[Re(NO)(CN)_5]^{-2}$
TMC-44 $[Re(NO)Cl_5]^{-2}$
TMC-45 $[Re(NO)Br_5]^{-2}$
TMC-46 $[Re(NO)Cl_2(CN)_3]^{-2}$
TMC-47 $[Ir(NO)Cl_5]^{-1}$
TMC-48 $[Ir(NO)Br_5]^{-1}$
TMC-49 $[Ir(NO)I_5]^{-1}$
TMC-50 $[Ir(NO)Cl_3BrI]^{-1}$
TMC-51 $[Ru(NS)Cl_5]^{-2}$
TMC-52 $[Os(NS)Br_5]^{-2}$
TMC-53 $[Ru(NS)I_5]^{-2}$
TMC-54 $[Os(NS)Cl_4(N_3)]^{-2}$
TMC-55 $[Ru(NS)Br_4(N_3)]^{-2}$
TMC-56 $[Os(NS)I_4(N_3)]^{-2}$
TMC-57 $[Ru(NS)Cl_4(CN)]^{-2}$
TMC-58 $[Os(NS)Br_4(CN)]^{-2}$
TMC-59 $[Ru(NS)I_4(CN)]^{-2}$
TMC-60 $[Os(NS)Cl_4(SCN)]^{-2}$
TMC-61 $[Ru(NS)Br_4(SCN)]^{-2}$
TMC-62 $[Os(NS)I_4(SCN)]^{-2}$
TMC-63 $[Ru(NS)Cl_4(SeCN)]^{-2}$
TMC-64 $[Os(NS)Br_4(SeCN)]^{-2}$
TMC-65 $[Ru(NS)I_4(SeCN)]^{-2}$
TMC-66 $[Os(NS)Cl_3(N_3)_2]^{-2}$
TMC-67 $[Ru(NS)Br_3(CN)_2]^{-2}$
TMC-68 $[Os(NS)Cl_3(SCN)_2]^{-2}$
TMC-69 $[Ru(NS)Cl_3(SeCN)_2]^{-2}$
TMC-70 $[Ru(NS)Cl_2(N_3)_3]^{-2}$
TMC-71 $[Os(NS)I_2(CN)_3]^{-2}$
TMC-72 $[Os(NS)Br_2(SCN)_3]^{-2}$
TMC-73 $[Ru(NS)Cl_2(SeCN)_3]^{-2}$
TMC-74 $[Ru(NS)Cl_2(N_3)_3]^{-2}$
TMC-75 $[Os(NS)I_2(CN)_3]^{-2}$
TMC-76 $[Ru(NS)Br_2(SCN)_3]^{-2}$
TMC-77 $[Os(NS)Cl_2(SeCN)_3]^{-2}$
TMC-78 $[Os(NS)Cl(N_3)_4]^{-2}$
TMC-79 $[Ru(NS)I(CN)_4]^{-2}$
TMC-80 $[Ru(NS)Cl(SCN)_4]^{-2}$
TMC-81 $[Os(NS)Cl(SeCN)_4]^{-2}$
TMC-82 $[Ru(NS)(CN)_5]^{-2}$
TMC 83 $[Ru(NS)(SCN)_5]^{-2}$
TMC-84 $[Os(NS)(SeCN)_5]^{-2}$
TMC-85 $[Ru(NS)(N_3)_5]^{-2}$
TMC-86 $[Mo(NO)_2(CN)_4]^{-2}$

Most preferred is $[Os(NO)Cl_5]^{-2}$. During its application, it is associated with a cation, namely $2Cs^{+1}$, to form $Cs_2Os(NO)Cl_5$.

If the silver halide grains of the present invention are modified by a dopant, it is preferable that the dopant be incorporated into a 93 percent core region of each silver halide grain; i.e. it is added during precipitation until 93 percent of the grain volume is formed. It may also, however, as long as it is positioned below the surface of the silver halide grain.

If the silver halide grains of the present invention are modified by a grain surface modifier, it is preferable to deposit the modifier at intervals along the surface of the silver halide grains in a silver bromide carrier. The silver bromide carrier, in such instances, accounts for less than about 2 molar percent, and preferably less than about 1 molar percent, of the crystals' total halide content.

Optimally, the silver bromide carrier is a Lippmann bromide emulsion, which is a very fine grain silver bromide emulsion having average grain sizes about 0.05 microns. Such an emulsion will have incorporated in its grains certain levels of the grain surface modifier. These emulsions are digested in the presence of the much larger silver halide grains of the present invention. They are then allowed to recrystallize on the surface of the larger grains, thus delivering the grain surface modifier.

Because the Lippmann bromide carriers account for less than about 2 molar percent (and preferably less than about 1 molar percent) of the total halide in the silver halide grains, they do not form a shell around the larger grains. Rather, they form deposits at intervals along the surface of the grains. Generally, these deposits will form at the corners of the silver halide grains.

It is also possible to form the emulsions of the present invention by adding the grain surface modifier alone to a post-precipitation emulsion, or with a solution of potassium bromide.

The dopant or grain surface modifier used in the present invention is preferably applied to a silver chloride emulsion which has been ripened in the presence of a ripening agent. Also, it is preferred that they are added to the emulsion in amounts between about 0.01 and about 10 micrograms per mole of silver halide. More preferably, they are applied in amounts between about 0.1 and about 5.0 micrograms per mole of silver halide. Most preferred, they are applied in amounts between about 0.75 and about 2.0 micrograms per mole of silver halide.

The invention may be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure*, December 1989, 308119, Sections I–IV at pages 993–1000.

After precipitation of the silver halide grains, the emulsions are washed to remove excess salt. They can then chemically or spectrally sensitized in any conventional manner as disclosed in the above-referenced *Research Disclosure* 308119.

Specific sensitizing dyes which can be used in accordance with the invention include the polymethine dye class, which further includes the cyanines, merocyanines, complex cyanines and merocyanines (i.e. tri-, tetra- and polynuclear cyanines and merocyanines), oxonols, hemioxonols, styryls, merostyryls, and streptocyanines. Other dyes which can be used are disclosed in *Research Disclosure* 308119.

Chemical sensitizers which can be used in accordance with the invention include the gold and sulfur class sensitizers, or the transition metal sensitizers as discussed above. Further, they can be combined with other known antifoggants or stabilizers such as those disclosed in *Research Disclosure* 308119, Section VI. These may include halide ions, chloropalladates, and chloropalladites. Moreover, they may include, quaternary ammonium salts, tellurazolium salts, and water soluble inorganic salts of transition metals such as magnesium, calcium, cadmium, cobalt, manganese, and zinc.

After sensitizing, the emulsions can be combined with any suitable coupler (whether two or four equivalent) and/or coupler dispersants to make the desired color film or print photographic materials; or they can be used in black-and-white photographic films and print material. Couplers which can be used in accordance with the invention are described in *Research Disclosure* Vol. 176, 1978, Section 17643 VIII and *Research Disclosure* 308119 Section VII, the entire disclosures of which are incorporated by reference.

The emulsions of the invention are preferably negative-working emulsions, but can also be positive-working emulsions. They can be incorporated into a photographic element, and processed, upon exposure, by any known method (such as those methods disclosed in U.S. Pat. No. 3,822,129 and *Research Disclosure* 308119 Section XIX). Typically, a color photographic element comprises a support, which can contain film or paper, sized by any known sizing method, and at least three different color forming emulsion layers. The element also typically contains additional layers, such as filter layers, interlayers, overcoat layers, subbing layers, and the like. It may contain brighteners, antistain agents, hardeners, plasticizers and lubricants, as well as matting agents and development modifiers. Specific examples of each of these, and their manners of application, are disclosed in the above-referenced *Research Disclosure* 308119, and *Research Disclosure* 17643.

The present invention also relates to a method of improving the sensitivity and stability of a silver halide emulsion comprising adding to said emulsion a photographically effective amount of an organic compound having a thiosulfonic acid substituent, an organic compound having a sulfinic acid substituent, and an alkynylamine. By photographically effective amount, it is meant an amount necessary to achieve some desired photographic effect. Such an amount is exemplified above in the description of the present invention's preferred photographic elements.

It is also contemplated that the methods of the invention comprise the further step of adding to the emulsion a photographically effective amount of a transition metal complex having the formula:

$$[ML_m(NZ)]^n$$

wherein:

M is a transition metal selected from Groups V to X, inclusive, of the period table;

Z is oxygen or sulfur, and together with the nitrogen forms a nitrosyl or thionitrosyl ligand;

L represents a ligand;

m is from 4 to 7; and n is zero, −1, −2, or −3.

The invention can be better appreciated by reference to the following specific examples. They are intended to be illustrative and not exhaustive of the emulsions of the present invention and their methods of formation and use.

EXAMPLES

Example 1

An emulsion in accordance with the present invention was made by adding an alknylamine to a chemically and blue spectrally sensitized monodisperse silver chloride negative emulsion having yellow dye-forming coupler alpha-(4-(4-benzyloxy-phenyl-sulfonyl)phenoxy)-alpha(pivalyl)-2-chloro-5-(gamma(2,4-di-5-amylphenoxy)butyramido)acetanilide) (1.08 g/m$^2$) in di-n-butylphthalate coupler solvent (0.27 g/m$^2$) and gelatin (1.51 g/m$^2$). In addition, 0.104 g of 1-(3-acetamidophenyl)-5-mercaptotetrazole and 1.033 g of potassium bromide per silver mole were added. The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight. The photographic element thus prepared was exposed with a tungsten lamp designed to simulate a color negative print exposure source. This lamp had a color temperature of 3000K, log lux 2.95, and the coatings were exposed through a combination of magenta and cyan filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The processing solutions utilized were:

| | |
|---|---|
| Developer | |
| Lithium salt of sulfonated polystyrene | 0.25 mL |
| Triethanolamine | 11.0 mL |
| N,N-diethylhydroxlamine (85% by wt.) | 6.0 mL |
| Potassium sulfite (45% by wt.) | 0.5 mL |
| Color developing agent (4-(N-ethyl-N-2-methanesulfonylaminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach Fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

The speed at 1.0 density was taken as a measure of the sensitivity of the emulsion. The toe was the density measured at a point 0.3 log E units faster than the relative speed point.

Table 1 illustrates the sensitivity enhancing effects of alkynylamine compounds A and G. Samples 2–5 demonstrate that emulsions containing compounds A and G exhibit speed increases over the control emulsion, with emulsions containing compound G exhibiting the larger increase. Samples 4 and 5 (compound G) also show a higher fog and toe density (softer toe) than samples 1 (control), or 2 and 3 (compound A).

After storage at 120° F. for two weeks, samples 2–5 show higher fog than the control sample (1), with the coatings containing compound G exhibiting a larger increase in fog than the coatings containing compound A. However, the former show less speed increase after incubation.

This data shows that the alkynylamines of the present invention enhance emulsion sensitivity while reducing speed instability. Such effects are seen, however, with a corresponding increase in fog when such emulsions are stored for an appreciable period of time.

TABLE I

| Compound A mg Ag mol | Compound G mg Ag mol | Sample | 2 week 0° F. Speed | Fog | Toe | 120° F. vs 0° F. Δ Speed | Δ Fog |
|---|---|---|---|---|---|---|---|
| 0 | 0 | 1 | 125 | 0.03 | 0.344 | 8.6 | 0.02 |
| 90 | 0 | 2 | 130 | 0.03 | 0.351 | 5.1 | 0.04 |
| 180 | 0 | 3 | 133 | 0.03 | 0.358 | 4.8 | 0.06 |
| 0 | 90 | 4 | 145 | 0.06 | 0.423 | 3.1 | 0.15 |
| 0 | 180 | 5 | 147 | 0.06 | 0.428 | 2.1 | 0.17 |

Example 2

In this example, the fog reducing effect of the combination of an alkynylamine, an organic compound having a thiosulfonic acid substituent, and an organic compound having a sulfinic acid substituent is demonstrated in a red sensitized emulsion. The emulsion was similarly sensitized as in example 1 except the emulsion was coated at 0.18 g Ag/m$^2$, and the cyan dye-forming coupler 2-(alpha(2,4-di-tert-amylphenoxy)butyramido)-4,6-dichloro-5-ethyl phenol (0.42 g/m$^2$) in di-n-butyl phthalate coupler solvent (0.429 g/m$^2$) and gelatin (1.08 g/m$^2$) was used. The amount of 1-(3-acetamidophenyl)-5-mercaptotetrazole and potassium bromide changed to 0.38 and 1.1 g per mole of silver, respectively. Compound G, sodium tolythiosulfonate (TSS) and sodium tolysulfinate (TS) were added to the emulsion just prior to coating.

Table II again demonstrates that when alkynylamines are used in a photographic emulsion, a speed increase can be obtained (samples 8 and 10). Furthermore, Table II demonstrates that when TSS and TS are incorporated into a photographic emulsion, they suppress speed and fog increase after incubation, but give substantially the same fresh speed (sample 7). The combination of an alkynylamine with TSS and TS (samples 9 and 11) demonstrate that increased speed and greater speed stability can be obtained without a corresponding decrease in fog stability after storage.

TABLE II

| Compound G mg Ag mol | TSS mg Ag mol | TS mg Ag mol | Sample # | 2 week 0° F. Speed | Fog | Toe | 120° F. vs 0° F. Δ Speed | Δ Fog |
|---|---|---|---|---|---|---|---|---|
| 0 | 0 | 0 | 6 | 162 | 0.10 | 0.291 | 7.5 | 0.31 |
| 00 | 20 | 200 | 7 | 163 | 0.10 | 0.292 | 0.5 | 0.19 |
| 5 | 00 | 0 | 8 | 167 | 0.10 | 0.305 | 7.4 | 0.33 |
| 5 | 2.5 | 25 | 9 | 166 | 0.09 | 0.290 | 4.9 | 0.29 |
| 20 | 00 | 00 | 10 | 169 | 0.11 | 0.309 | 4.3 | 0.33 |
| 20 | 10 | 100 | 11 | 170 | 0.11 | 0.306 | 1.7 | 0.28 |

Example 3

During the precipitation of a 0.73 μm silver chloride emulsion, 0.75 μg of $Cs_2Os(NO)Cl_5$ per mole silver was added. The emulsion was then sensitized as in example 1. Compound G and a mixture of TSS and TS was added to the emulsion prior to coating.

Table III demonstrates that the combination of TSS, TS, an alkynylamine such as compound G, and transition metal complex dopant (sample 19), in a photographic emulsion, can result in such an emulsion exhibiting increased speed, contrast, and speed and fog stability.

TABLE III

| Os(NO) | Compound G mg | TSS | TS | | 1 week | | | | |
|---|---|---|---|---|---|---|---|---|---|
| | | | | | 0° F. | | | 120° F. vs 0° F. | |
| | Ag mol | | | Sample # | Speed | Fog | Toe | ΔSpeed | ΔFog |
| N | 0 | 0 | 0 | 12 | 87 | 0.05 | 0.355 | 13 | 0.018 |
| N | 0 | 480 | 4800 | 13 | 85 | 0.05 | 0.356 | 3.7 | 0.002 |
| N | 50 | 0 | 0 | 14 | 104 | 0.06 | 0.388 | 3.3 | 0.025 |
| N | 50 | 480 | 4800 | 15 | 99 | 0.05 | 0.368 | 1.8 | 0.005 |
| Y | 0 | 0 | 0 | 16 | 95 | 0.04 | 0.368 | 2.0 | 0.003 |
| Y | 0 | 480 | 4800 | 17 | 94 | 0.04 | 0.337 | −1.1 | 0.003 |
| Y | 50 | 0 | 0 | 18 | 117 | 0.05 | 0.378 | −2.9 | 0.049 |
| Y | 50 | 480 | 4800 | 19 | 107 | 0.04 | 0.350 | −3.2 | 0.011 |

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion layer, wherein said emulsion layer contains a photographically effective amount of an organic compound having a thiosulfonic acid substituent, an organic compound having a sulfinic acid substituent, and an alkynylamine.

2. A photographic element according to claim 1, wherein said emulsion layer is comprised of silver halide grains which are predominantly silver chloride.

3. A photographic element according to claim 2, wherein said silver halide grains contain at least 70 molar percent silver chloride and less than 2 molar percent silver iodide, with the remaining silver halide being silver bromide.

4. A photographic element according to claim 3, wherein said silver halide grains contain at least 98 molar percent silver chloride, with the remaining silver halide being silver bromide and silver iodide.

5. A photographic element according to claim 4, wherein chloride is the sole halide in said silver halide grains.

6. A photographic element according to claim 2 wherein the organic compound having a thiosulfonic acid substituent satisfies the formula:

$$R^1—SO_2S—M^1$$

where $R^1$ represents an aliphatic, carbocyclic, or heterocyclic group which may be substituted or unsubstituted, and $M^1$ represents any mono-, di-, or tri-valent cation; and wherein the organic compound having a sulfinic acid substituent satisfies the formula:

$$R^2—SO_2—M^2$$

where $R^2$ represents an aliphatic, carbocyclic, or heterocyclic group, which may be substituted or unsubstituted, and $M^2$ represents a mono-, di-, or tri-valent cation.

7. A photographic element according to claim 6 wherein the organic compound having a thiosulfonic acid substituent is in an amount between about 20 and about 2300 milligrams per mole of silver halide, and the organic compound having a sulfinic acid substituent is in an amount between about 20 and about 20,000 milligrams per mole of silver halide, with the ratio of the compound containing the thiosulfonic acid substituent to the compound containing the sulfinic acid substituent being between about 20:1 and about 1:20 by weight.

8. A photographic element according to claim 7 wherein the organic compound having a thiosulfonic acid substituent is in an amount between about 100 and about 1500 milligrams per mole of silver halide, and the organic compound having a sulfinic acid substituent is in an amount between about 100 and about 15,000 milligrams per mole of silver halide, with the ratio of the compound containing the thiosulfonic acid substituent to the compound containing the sulfinic acid substituent being between 10:1 and 1:10 by weight.

9. A photographic element according to claim 8 wherein the organic compound having a thiosulfonic acid substituent is a tolylthiosulfonate salt, and the organic compound having a sulfinic acid substituent is a tolylsulfinate salt.

10. A photographic element according to claim 9 wherein the alkynylamine satisfies the formula:

$$Y—NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocycle.

11. A photographic element according to claim 10 comprising the alkynylamine in an amount between about 0.1 and about 1000 milligrams per mole of silver halide.

12. A photographic element according to claim 11 comprising the alkynylamine in an amount between about 1 and about 500 milligrams per mole of silver halide.

13. A photographic element according to claim 12, wherein the alkynylamine is a substituted or unsubstituted butynylaminobenzoxazole.

14. A photographic element according to claim 13 comprising butynylaminobenzoxazole in an amount between about 1 and about 200 milligrams per mole of silver halide.

15. A photographic element according to claim 14 further comprising a transition metal complex having the formula:

$$[ML_m(NZ)]^n$$

wherein

M is a transition metal selected from Groups V to X, inclusive, of the periodic table;

Z is oxygen or sulfur, and together with the nitrogen forms a nitrosyl or thionitrosyl ligand;

L represents a ligand;

m is from 4 to 7; and n is zero, −1, −2, or −3.

16. A photographic element according to claim 15 wherein M is osmium.

17. A photographic element according to claim 16 wherein the transition metal complex is $[Os(NO)Cl_5]^{-2}$.

18. A photographic element according to claim 17 comprising $[Os(NO)Cl_5]^{-2}$ in an amount between about 0.01 microgram and about 10 micrograms per mole of silver halide.

19. A photographic element according to claim 18 comprising $[Os(NO)Cl_5]^{-2}$ in an amount between about 0.1 microgram and about 5.0 micrograms per mole of silver halide.

20. A photographic element comprising a support and a silver halide emulsion layer, wherein said emulsion layer contains a photographically effective amount of a thiosulfonic acid compound, a sulfinic acid compound, and an alkynylamine; and wherein said emulsion layer is comprised of silver halide grains which are predominantly silver chloride, and which internally contain a photographically effective amount of a dopant comprised of a nitrosyl or thionitrosyl ligand and a transition metal chosen from Groups V to X, inclusive, of the periodic table.

21. A method of improving the sensitivity and stability of a silver halide emulsion comprising adding to said emulsion a photographically effective amount of an organic compound having a thiosulfonic acid substituent, an organic compound having a sulfinic acid substituent, and an alkynylamine.

22. A method according to claim 21 further comprising adding to said emulsion a photographically effective amount of a transition metal complex having the formula:

$$[ML_m(NZ)]^n$$

wherein:

M is a transition metal selected from Groups V to X, inclusive, of the period table;

Z is oxygen or sulfur, and together with the nitrogen forms a nitrosyl or thionitrosyl ligand;

L represents a ligand;

m is from 4 to 7; and n is zero, −1, −2, or −3.

* * * * *